US011268545B2

(12) United States Patent
Szeles et al.

(10) Patent No.: US 11,268,545 B2
(45) Date of Patent: Mar. 8, 2022

(54) HYDRAULIC CONTROL ARRANGEMENT FOR SUPPLYING PRESSURE MEDIUM TO AT LEAST TWO HYDRAULIC CONSUMERS

(71) Applicant: Robert Bosch GmbH, Stuttgart (DE)

(72) Inventors: Botond Szeles, Senden (DE); Matthias Jerg, Neu-Ulm (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/079,666

(22) Filed: Oct. 26, 2020

(65) Prior Publication Data

US 2021/0131455 A1 May 6, 2021

(30) Foreign Application Priority Data

Oct. 30, 2019 (DE) ..... 10 2019 216 771.3

(51) Int. Cl.
*F15B 13/04* (2006.01)
*E02F 9/22* (2006.01)

(52) U.S. Cl.
CPC ..... *F15B 13/0417* (2013.01); *E02F 9/2235* (2013.01); *F15B 2211/20553* (2013.01); *F15B 2211/329* (2013.01); *F15B 2211/351* (2013.01); *F15B 2211/6054* (2013.01); *F15B 2211/71* (2013.01)

(58) Field of Classification Search
CPC . E02F 9/2235; F15B 2211/71; F15B 13/0417; F15B 2211/6054; F15B 2211/351
See application file for complete search history.

(56) References Cited

U.S. PATENT DOCUMENTS 7,275,370 B2 * 10/2007 Hesse ..... E02F 9/2235 60/445

FOREIGN PATENT DOCUMENTS

DE 43 41 244 A1 6/1995
DE 197 14 141 A1 10/1998
DE 103 32 120 A1 2/2005
(Continued)

OTHER PUBLICATIONS

European search report corresponding to European Patent Application No. 20 20 3260 dated Mar. 25, 2021 (11 pages).

*Primary Examiner* — Abiy Teka
(74) *Attorney, Agent, or Firm* — Maginot, Moore & Beck LLP

(57) ABSTRACT

A hydraulic control arrangement for simultaneously supplying at least two hydraulic consumers with predefinable individual pressure medium flow rates includes a hydraulic pump having an adjustable swept volume, and at least two valve arrangements each including a variable metering restrictor and a pressure balance arranged downstream of the variable metering restrictor. Each pressure balance is configured to be acted on in an opening direction by pressure downstream of the respective variable metering restrictor and to be acted on in a closing direction by a highest load pressure or by a pressure derived therefrom. Each valve arrangement is arranged between a pump line, which leads away from the hydraulic pump, and a consumer of the at least two hydraulic consumers. The arrangement further includes an electronic control device, by which the hydraulic pump is actuatable such that it conveys a sum of the predefinable individual pressure medium flow rates.

10 Claims, 3 Drawing Sheets

(56) References Cited

FOREIGN PATENT DOCUMENTS

| | | | |
|---|---|---|---|
| EP | 0 566 449 | B1 | 10/1993 |
| EP | 2 541 072 | A2 | 1/2013 |
| WO | 2005/024245 | A1 | 3/2005 |

* cited by examiner

HYDRAULIC CONTROL ARRANGEMENT FOR SUPPLYING PRESSURE MEDIUM TO AT LEAST TWO HYDRAULIC CONSUMERS

This application claims priority under 35 U.S.C. § 119 to patent application number DE 10 2019 216 771.3, filed on Oct. 30, 2019 in Germany, the disclosure of which is incorporated herein by reference in its entirety.

The disclosure relates to a hydraulic control arrangement, by means of which at least two hydraulic consumers can be simultaneously supplied with predefinable individual pressure medium flow rates and which has a hydraulic pump, which hydraulic pump is adjustable in terms of its swept volume, at least two valve arrangements, each of which valve arrangements comprises a variable metering restrictor and a pressure balance arranged downstream of the variable metering restrictor, which pressure balance can be acted on in an opening direction by the pressure downstream of the respective variable metering restrictor and can be acted on in a closing direction by the highest load pressure or by a pressure derived therefrom, and each of which valve arrangements is arranged between a pump line, which leads away from the hydraulic pump, and a hydraulic consumer, and having an electronic control device, by which the hydraulic pump is actuatable such that it conveys the sum of the individual pressure medium flow rates and by which the variable metering restrictors can, in the case of a sufficient conveying flow rate of the hydraulic pump, be actuated with control signals such that the throughflow cross sections thereof have the same ratios with respect to one another as the individual pressure medium flow rates.

BACKGROUND

DE 197 14 141 A1 has disclosed a hydraulic control arrangement in the case of which pressure balances arranged in series with respect to the variable metering restrictors are acted on in an opening direction by the pressure downstream of the respective variable metering restrictor and by a spring and in a closing direction by the pressure upstream of the variable metering restrictor. The pressure balance is commonly arranged upstream of the variable metering restrictor, such that the pressure downstream of the variable metering restrictor is the load pressure of the respective hydraulic consumer. In the case of this known hydraulic control arrangement, the highest load pressure is selected by means of a shuttle valve chain and is signaled to a closed-loop load-sensing controller of the hydraulic pump which sets the swept volume of the hydraulic pump such that the pump pressure prevailing in the pump line lies above the highest load pressure by a fixed pressure difference of, for example, bar. In the case of such a hydraulic control arrangement, the pressure medium flow rate flowing to a hydraulic consumer is determined, independently of load pressure, exclusively by the throughflow cross section of the respective variable metering restrictor, as long as the sum of the individual pressure medium flow rates, which is predefined by the sum of the throughflow cross sections of the variable metering restrictors, does not exceed the maximum conveying flow rate of the hydraulic pump. Such a hydraulic control arrangement is therefore also referred to as a load-sensing (LS) control arrangement. The hydraulic pump seeks in each case to convey the pressure medium flow rate that is determined as a demand on the basis of the throughflow cross sections of the variable metering restrictors. This can therefore also be referred to as demand-based closed-loop flow control. In the case of the supply deficit, that is to say if the sum of the individual pressure medium flow rates exceeds the maximum conveying flow rate of the hydraulic pump, which is determined from the maximum swept volume and the rotational speed of the hydraulic pump, only a pressure medium flow rate which is lower than that desired flows to the hydraulic consumer with the highest load pressure.

In the case of another type of hydraulic LS control arrangement, known for example from EP 566 449 B1, the pressure balances are positioned downstream of the variable metering restrictors and are acted on in an opening direction by the pressure downstream of the respective variable metering restrictor and in a closing direction by a control pressure prevailing in a control chamber, which control pressure commonly corresponds to the highest load pressure of all hydraulic consumers supplied by the same hydraulic pump. If, in the event of a simultaneous actuation of multiple hydraulic consumers, the variable metering restrictors are opened to such an extent that the pressure medium flow rate delivered by the hydraulic pump adjusted as far as the stop is lower than the total demanded pressure medium flow rate, that is to say a supply deficit is present, the pressure medium flow rates flowing to the individual hydraulic consumers are reduced, independently of the respective load pressure of the hydraulic consumer, in the ratio of the actual conveying flow rate with respect to the desired conveying flow rate. This is therefore referred to as a hydraulic control arrangement with load-independent throughflow distribution (LUDV control). Because it is also the case in such an LUDV control arrangement that the highest load pressure is sensed and a pump pressure which lies above the highest load pressure by a particular pressure difference is generated by the hydraulic pump, such an LUDV control arrangement is a special case of an LS control arrangement.

DE 103 32 120 A1 has disclosed a hydraulic control arrangement which operates in accordance with the so-called EFM (electronic flow matching) principle and in the case of which the hydraulic pump is controlled in a manner dependent on a control signal output by an electrical control device, which control signal corresponds to the sum of the individual pressure medium flow rates of all simultaneously actuated hydraulic consumers taking into consideration the rotational speed of the hydraulic pump, such that the hydraulic pump conveys the sum of the individual pressure medium flow rates. Between the hydraulic pump and each hydraulic consumer, there is situated a valve arrangement which, as in the case of an LUDV control arrangement, comprises a variable metering restrictor and a pressure balance arranged downstream of the variable metering restrictor, which pressure balance can be acted on in an opening direction by the pressure downstream of the respective variable metering restrictor and in a closing direction by the highest load pressure. A low-strength spring may also act in the closing direction. The variable metering restrictors are actuatable by the electrical control device with control signals such that the throughflow cross sections are in the same ratios with respect to one another as the individual pressure medium flow rates. Here, it is not of importance for the conveying flow rate of the hydraulic pump and the throughflow cross sections of the variable metering restrictors to be exactly coordinated with one another, because the throughflow distribution is determined by the throughflow cross sections of the variable metering restrictors, and deviations in the conveying flow rate of the hydraulic pump manifests not in another movement sequence but merely in the speed of the movement sequence. This can however be easily corrected through the inputting of different setpoint values, which is commonly performed by means of a joystick, for the individual pressure medium flow rates. In the case of a supply deficit, it is also the case in the EFM control arrangement known from DE 10332120 A1 that the pressure medium flow rates flowing to the individual hydraulic consumers are reduced, independently of the respective load pressure of the hydraulic consumers, in the ratio of the actual conveying flow rate to the desired conveying flow rate.

SUMMARY

The disclosure is based on the object of further developing a hydraulic control arrangement having the features specified in the introduction such that one hydraulic consumer or multiple hydraulic consumers are supplied preferentially with hydraulic pressure medium in relation to other hydraulic consumers in the case of a supply deficit.

Said object is achieved in that, in the case that multiple variable metering restrictors are actuated simultaneously and, in the event of a supply deficit, the sum of the individual pressure medium flow rates exceeds the maximum conveying flow rate of the hydraulic pump, it is possible, for the benefit of a hydraulic consumer which is to be preferentially supplied with pressure medium, for the simultaneously actuated variable metering restrictors to be actuated with control signals, the ratios of which with respect to one another deviate from the ratios of the predefined individual pressure medium flow rates. Thus, in a hydraulic control arrangement according to the disclosure, in the case of a supply deficit, the ratios between the throughflow cross sections of the simultaneously actuated variable metering restrictors are changed in relation to the throughflow cross sections that correspond to the predefined individual pressure medium flow rates.

The ratios between the throughflow cross sections can be changed in the event of a supply deficit in that the throughflow cross section of a variable metering restrictor assigned to a preferential hydraulic consumer is, in the case of the same predefined pressure medium flow rate for said consumer, increased in size in relation to the case of the sufficient conveying flow rate. An increase in size of the throughflow cross section is however possible only up to the maximum throughflow cross section. Furthermore, the behavior of a hydraulic consumer may be more stable in the case of small throughflow cross sections than in the case of large throughflow cross sections.

It is therefore particularly preferred if, in the event of a supply deficit, the throughflow cross section of a variable metering restrictor assigned to a lower-priority hydraulic consumer is, in the case of the same predefined pressure medium flow rate for said consumer, reduced in size in relation to the case of the sufficient conveying flow rate. It is however also possible, in the case of a supply deficit, to simultaneously increase the size of the throughflow cross section of the variable metering restrictor of a preferential hydraulic consumer and to reduce the size of the throughflow cross section of the variable metering restrictor of a lower-priority hydraulic consumer.

It is also possible, in the case of a supply deficit, for the variable metering restrictor assigned to a preferential hydraulic consumer and the variable metering restrictor assigned to a lower-priority hydraulic consumer to be actuated such that, in relation to the case of a sufficient conveying flow rate, the ratio between the control signal for the variable metering restrictor assigned to the preferential hydraulic consumer and the control signal for the variable metering restrictor assigned to the lower-priority hydraulic consumer is increased, and the pressure medium flow rate flowing to the preferential hydraulic consumer is reduced. This means that, in the case of the supply deficit, although not the predefined individual pressure medium flow rate flows to the preferential hydraulic consumer, it is however the case that a greater pressure medium flow rate flows to it in relation to the lower-priority hydraulic consumer than in the case of a sufficient conveying flow rate of the hydraulic pump.

It may be provided that, in the case of a supply deficit, the variable metering restrictors are actuatable such that a minimum flow rate of pressure medium still flows to the lower-priority hydraulic consumer.

A group with at least two equally preferential hydraulic consumers may be present, wherein, in the case of a supply deficit, the control signals to the variable metering restrictors assigned to said equally preferential hydraulic consumers are changed proportionally in relation to the control signals in the case of a sufficient conveying flow rate.

It is also possible for a group with at least two equally lower-priority hydraulic consumers to be present, wherein, in the case of a supply deficit, the control signals to the variable metering restrictors assigned to said lower-priority hydraulic consumers are changed proportionally in relation to the control signals in the case of a sufficient conveying flow rate.

Preferably, in the case of a supply deficit, a minimum flow rate still flows, in sum total, to the group of lower-priority hydraulic consumers.

If the hydraulic pump is not driven at a constant rotational speed, as is normally the case in applications on mobile work machines, then the electronic control device has an input for a signal which indicates the rotational speed of the hydraulic pump. With the aid of the known maximum swept volume of the hydraulic pump and the rotational speed of the hydraulic pump, the electronic control device can ascertain the present maximum conveying flow rate.

Basically, a hydraulic control arrangement according to the disclosure may be designed such that the highest load pressure is fed to a closed-loop control valve of the hydraulic pump, and the hydraulic pump is controlled in closed-loop fashion, as in the case of known load-sensing control arrangements, so as to convey a volume flow which generates a pump pressure which is higher than the highest load pressure by a particular pressure difference. A design of a hydraulic control arrangement according to the disclosure is however particularly preferred in which the hydraulic pump can be controlled with closed-loop volume flow control by the electronic control device, with a control signal corresponding to the sum of the individual pressure medium flow rates taking into consideration the rotational speed of the hydraulic pump, such that said hydraulic pump conveys the sum of the predefined individual pressure medium flow rates. The swept volume to which the hydraulic pump is to be set in the case of a particular sum of the individual pressure medium flow rates is determined from the rotational speed and the sum of the predefined individual pressure medium flow rates.

Each variable metering restrictor is advantageously formed at a control slide valve, the control slide valve is electrohydraulically actuatable.

At least one operator control element, for example a joystick, may be present for the generation of signals, corresponding to the individual pressure medium flow rates, for the electronic control device.

BRIEF DESCRIPTION OF THE DRAWINGS

Two exemplary embodiments of a hydraulic control arrangement according to the disclosure, a diagram with an exemplary distribution of a maximum conveying flow rate of a hydraulic pump between different hydraulic consumers, and a more detailed circuit diagram of a hydraulic pump, the swept volume of which is electronically controlled in closed-loop fashion and which is usable in a hydraulic control arrangement as per FIG. 1 or 2, are illustrated in the drawings. The disclosure will now be discussed in more detail on the basis of these drawings, in which:

FIG. 1 shows the first exemplary embodiment, in which the highest load pressure is signaled to the load-sensing closed-loop control hydraulic pump and an electronic control unit actuates the variable metering restrictors, FIG. 2 shows the second exemplary embodiment, in which an electronic control unit not only actuates the variable metering restrictors but also outputs an electrical signal, which corresponds to the sum of the pressure medium flow rates predefined for the hydraulic consumers, to a pump closed-loop controller.

DETAILED DESCRIPTION

Figure 1:
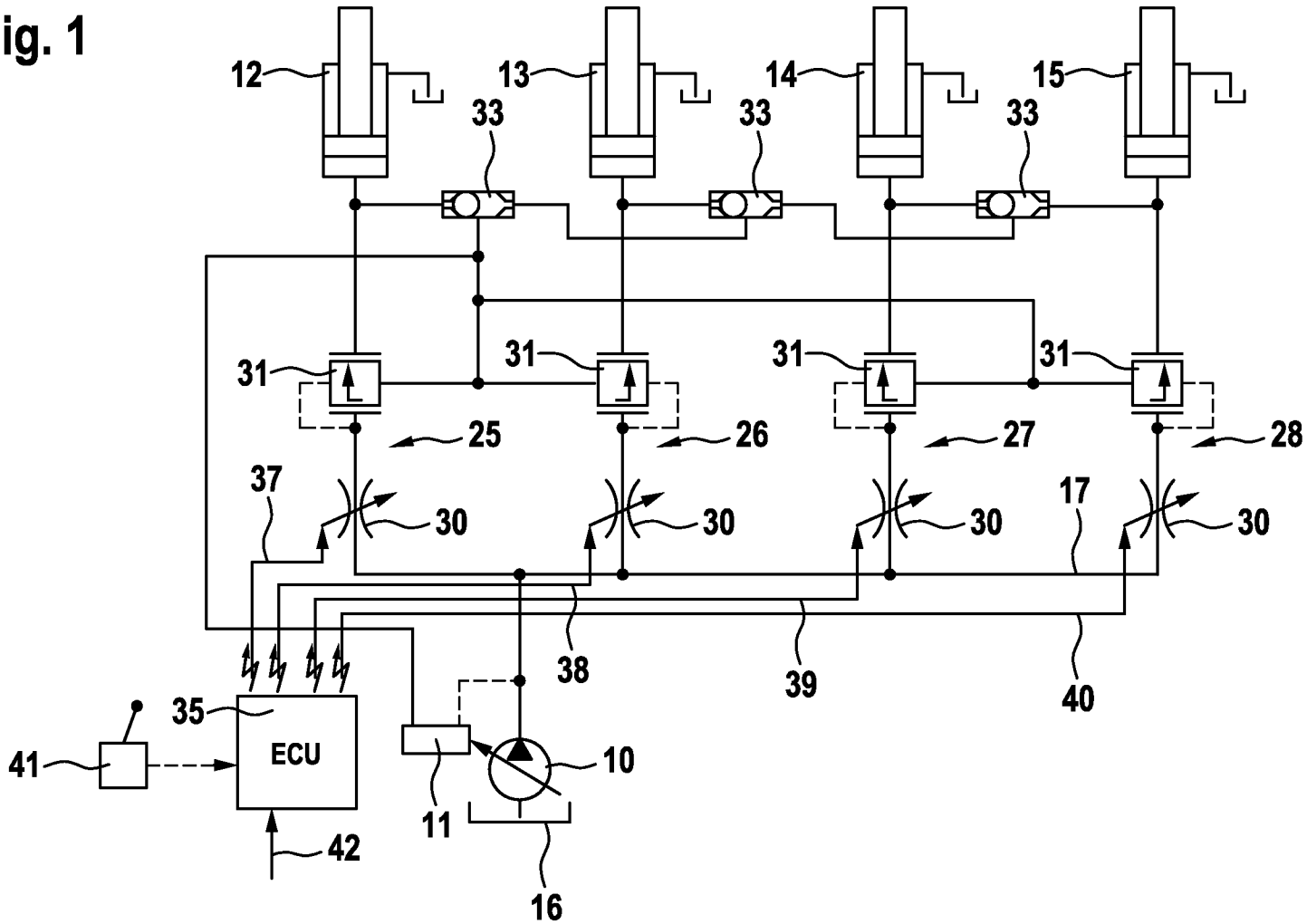

The hydraulic control arrangement as per FIG. 1 includes a hydraulic pump 10 which is adjustable in terms of its swept volume, has a load-sensing closed-loop controller 11 and by which, in the exemplary embodiment, four hydraulic cylinders 12, 13, 14 and 15 as hydraulic consumers can be supplied with pressure medium. The hydraulic pump 10 is, by way of example, an axial piston pump and draws in pressure medium from a tank 16 and discharges said pressure medium into a pump line 17. The load-sensing closed-loop controller 11 is connected to the pump line 17. Furthermore, the highest load pressure of all simultaneously actuated hydraulic consumers is signaled to the load-sensing closed-loop controller 11. By means of the load-sensing closed-loop controller 11, the swept volume of the hydraulic pump 10 is set such that the pressure in the pump line 17 lies above the highest load pressure by a particular pressure difference, the so-called pump $\Delta p$.

Figure 2:
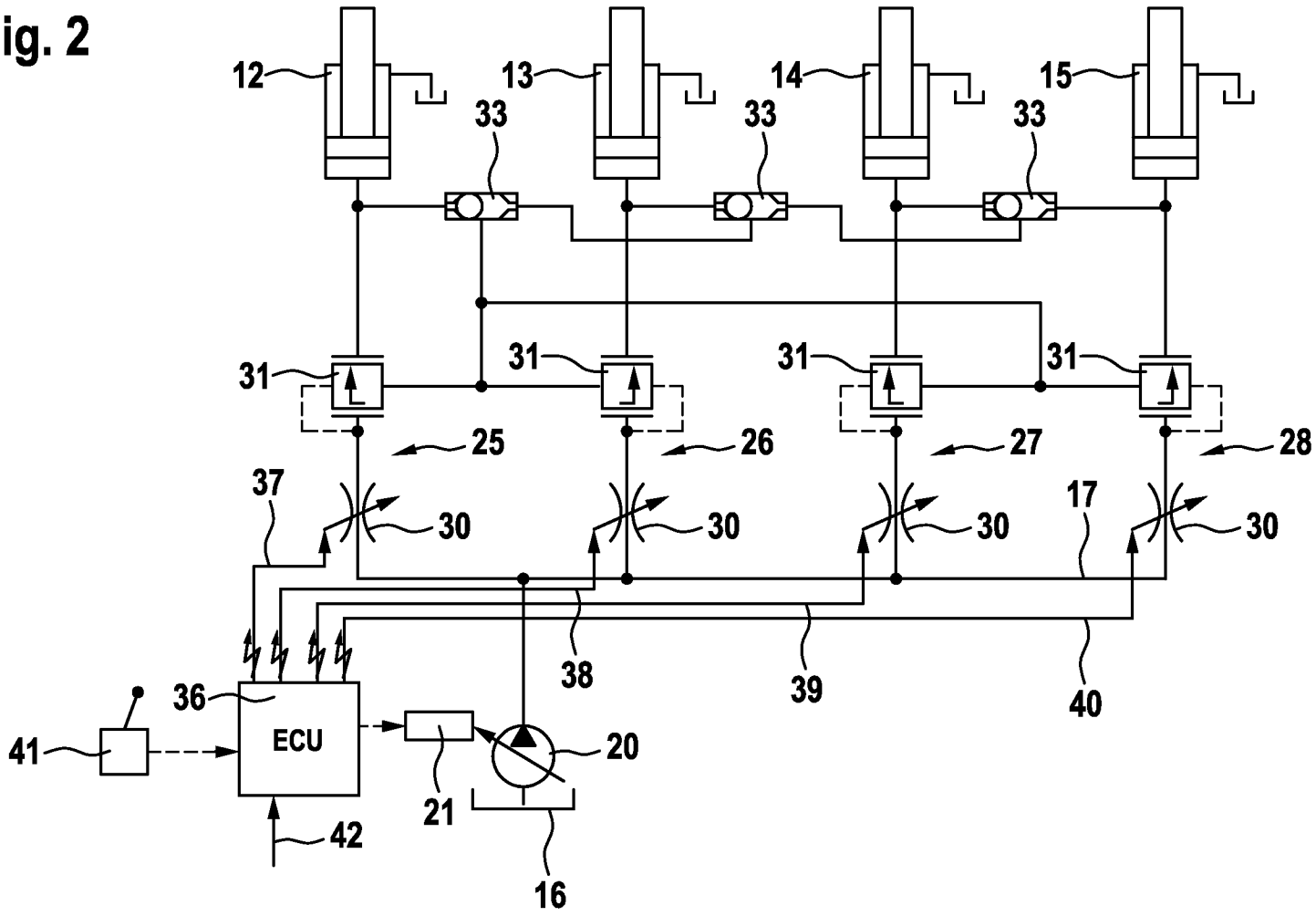

The hydraulic control arrangement as per FIG. 2 includes a hydraulic pump 20 which is likewise adjustable in terms of its swept volume and which draws in pressure medium from a tank 16 and discharges said pressure medium into a pump line 17. The hydraulic pump 20 also supplies four hydraulic cylinders 12, 13, 14 and 15 with pressure medium. By contrast to the exemplary embodiment as per FIG. 1, the hydraulic pump 20 however does not have load-sensing closed-loop control, but rather has closed-loop volume control and has for example an EP closed-loop control unit 21. In the case of EP closed-loop control, the swept volume of a hydraulic pump is set proportionally in relation to an electrical signal, for example proportionally in relation to the level of the electrical current flowing through an electroproportional magnet.

In both hydraulic control arrangements, the hydraulic consumer 12 is fluidically connectable via a valve arrangement 25, the hydraulic consumer 13 is fluidically connectable via a valve arrangement 26, the hydraulic consumer 14 is fluidically connectable via a valve arrangement 27 and the hydraulic consumer 15 is fluidically connectable via a valve arrangement 28 to the pump line 17. Each valve arrangement 25, 26, 27 and 28 has an electrohydraulically proportionally adjustable variable metering restrictor 30, which is commonly formed at a control slide valve which also serves for the directional control of the respective hydraulic consumer, and a pressure balance 31, which is arranged downstream of the variable metering restrictor 30, between the latter and the respective hydraulic consumer. All pressure balances 31 are acted on in a closing direction by the highest load pressure of all simultaneously actuated hydraulic consumers and possibly by a low-strength spring and in an opening direction by the pressure prevailing between a variable metering restrictor and a pressure balance. If one disregards a low-strength spring that may be present, then the pressure between a variable metering restrictor and a pressure balance is equal to the highest load pressure, because the closed-loop control piston of a pressure balance seeks in each case to assume a position in which forces acting thereon are in equilibrium, and said closed-loop control piston therefore throttles the volume of flow flowing to a hydraulic consumer in each case with such intensity until the pressure acting in an opening direction is equal to the highest load pressure acting in the closing direction. Because all pressure balances are acted on with the same force in a closing direction, the same pressure prevails downstream of all variable metering restrictors, such that the same pressure difference prevails across all variable metering restrictors, specifically the difference between the pump pressure prevailing in the pump line and the pressure downstream of the variable metering restrictors. If the pump pressure changes, the pressure difference across all actuated variable metering restrictors changes by the same amount irrespective of the individual load pressure of the hydraulic consumers. This means that, in the event of a change of the pump pressure, the volume flow distribution between the actuated variable metering restrictors is maintained irrespective of load pressure.

In both exemplary embodiments, the highest load pressure is selected by way of a chain of shuttle valves 33 and transmitted to one side of the pressure balances 31. In the exemplary embodiment as per FIG. 1, the highest load pressure is additionally signaled to the load-sensing closed-loop controller. The latter is not the case in the exemplary embodiment as per FIG. 2.

In FIGS. 1 and 2, for the sake of simplicity, the lines and channels which connect the hydraulic cylinders to a tank, and the throughflow cross sections of which are likewise opened or closed in controlled fashion by means of the control slide valve with the variable metering restrictors, have been omitted.

The hydraulic control arrangement as per FIG. 1 has an electronic control unit 35 which is connected via electrical lines 37, 38, 39 and 40 to electrical actuators (not illustrated in any more detail), for example to electroproportional magnets, each of which actuates a pilot valve in the form of a pressure reduction valve. The throughflow cross section of a variable metering restrictor 30 is set proportionally with respect to an electrical signal that is generated by the electronic control unit 35. Control signals are fed to the electronic control unit 35 by a joystick 41, which control signals constitute the setpoint signals for the throughflow cross section of the variable metering restrictors and thus the setpoint volume flows to the hydraulic cylinders and thus the setpoint speed with which a hydraulic cylinder is intended to move. Furthermore, an input signal 42 which represents the rotational speed of the hydraulic pump 20 is also fed to the control unit 35.

The hydraulic control arrangement as per FIG. 2 has an electronic control unit 36 which, like the control unit from FIG. 1, actuates the variable metering restrictors via electrical lines 36, 37, 38 and 39. Aside from the signals from the joystick 41, an input signal 42 which represents the rotational speed of the hydraulic pump 20 is also fed to the control unit 36 of the exemplary embodiment as per FIG. 2. In the control unit 36, a sum signal is formed from the signals, generated by means of the joystick 41, for the individual pressure medium flow rates flowing to the hydraulic cylinders, which sum signal corresponds to the sum of all predefined individual pressure medium flow rates. From the sum signal, taking into consideration the rotational speed of the hydraulic pump 20, a control signal for the EP closed-loop control unit 21 of the hydraulic pump 20 is generated in the control unit 36, which control signal sets such a swept volume of the hydraulic pump 20 that, at the given rotational speed, said hydraulic pump conveys the sum of all predefined individual pressure medium flow rates. If the rotational speed or the sum signal change, then the control signal for the EP closed-loop control unit 21 is also changed.

In both exemplary embodiments, the control units 35 and 36, via the electrical lines 36, 37, 38 and 39, actuate the variable metering restrictors 30 of the valve arrangements 25, 26, 27 and 28, in a manner dependent on the individual pressure medium flow rates predefined by means of the joystick 41, such that, at the variable metering restrictors, throughflow cross sections are consequently generated which have the same ratio with respect to one another as the predefined individual pressure medium flow rates. If one assumes, by way of example, that the same first pressure medium flow rate is to flow to both hydraulic cylinders 12 and 13 simultaneously, a second pressure medium flow rate which is twice the first pressure medium flow rate is to flow to the hydraulic cylinder 14, and a third pressure medium flow rate which is three times the first pressure medium flow rate is to flow to the hydraulic cylinder 15, then the variable metering restrictors are actuated such that their throughflow cross sections have a ratio of one to one to two to three.

In the exemplary embodiment as per FIG. 1, for particular individual pressure medium flow rates, it is necessary here to set very particular throughflow cross sections at the variable metering restrictors, because other throughflow cross sections lead to more pronounced or less pronounced throttling of the volume flows, thus to a change in the pump pressure, and thus to a change in the conveying flow rate of the hydraulic pump 10.

By contrast, in the exemplary embodiment as per FIG. 2, the conveying flow rate of the hydraulic pump 20 is independent of the size of the throughflow cross sections of the variable metering restrictors 30 in the case of predefined individual pressure medium flow rates. Depending on the size of the throughflow cross sections, a higher or lower pump pressure takes effect. In practice, the throughflow cross sections are selected such that a pressure drop in the range between 10 bar and 20 bar takes effect across the variable metering restrictors, as also exists across the variable metering restrictors of the exemplary embodiment as per FIG. 1. Alternatively, it is possible in each case for that variable metering restrictor which is assigned to the hydraulic consumer with the largest volume flow demand to be opened fully, wherein the variable metering restrictors of the other simultaneously actuated hydraulic consumers are opened up further in the same ratio, as described in DE 103 32 120 A1.

In the case of an actuation of the variable metering restrictors in a manner corresponding to the predefined individual pressure medium flow rates, the pressure medium flow rates flowing to the hydraulic consumers would be relatively reduced if the hydraulic pump cannot convey the sum of the predefined individual pressure medium flow rates, that is to say in the case of the supply deficit.

According to the disclosure, it is however now provided that, in the case of the supply deficit, particular hydraulic consumers are supplied with pressure medium preferentially in relation to other hydraulic consumers. For this purpose, in the case of the hydraulic control arrangements as per FIGS. 1 and 2, it is possible, for the benefit of a hydraulic consumer which is to be preferentially supplied with pressure medium, for the simultaneously actuated variable metering restrictors to be actuated with control signals, the ratios of which with respect to one another deviate from the ratios of the predefined individual pressure medium flow rates. Here, actuation is possible such that the individual pressure medium flow rate predefined for a preferential hydraulic consumer flows to the latter in all situations. It is however also conceivable that that to a preferential hydraulic consumer is reduced to a relatively lesser degree, in the case of the supply deficit, than for lower-priority hydraulic consumers.

By way of example, let it be assumed that, in the case of the hydraulic control arrangements as per FIGS. 1 and 2, the hydraulic cylinder 12 is a preferential hydraulic consumer to which the predefined pressure medium flow rate should flow in all situations. The other hydraulic cylinders 13, 14, 15 are of equal priority. The hydraulic pump 10 or 20 is capable, at the present rotational speed, of conveying a maximum of 180 liters. It is the intention for 80 liters to flow to the hydraulic cylinder 12, for liters to flow to the hydraulic cylinder 13, for 40 liters to flow to the hydraulic cylinder 14, and for nothing to flow to the hydraulic cylinder 15. The specified numbers of liters relate in each case to 1 minute. Thus, at the present moment, a sum total of 180 liters is demanded. No supply deficit is present, and the variable metering restrictors of the valve arrangements 25, 26 and 27 are opened in a manner corresponding to the predefined individual pressure medium flow rates.

By means of the joystick 41, it is now the case that, for the hydraulic cylinder 14, instead of 40 liters, 60 liters is now also demanded, as for the hydraulic cylinder 13, such that the sum of the predefined individual pressure medium flow rates increases to 200 liters. In the control unit 35 or 36, it is identified that a supply deficit is present. Depending on what sequence is stored in the control unit, the actuation of the variable metering restrictors is now changed in a different way. The throughflow cross section of the variable metering restrictor assigned to the hydraulic cylinder 12 can remain unchanged, whereas the throughflow cross sections of the variable metering restrictors assigned to the hydraulic cylinders 13 and 14 can be reduced to a throughflow cross section which corresponds to 50 liters. It is however also possible for the throughflow cross section of the variable metering restrictor assigned to the hydraulic cylinder 12 to be increased in size to 96 liters while the throughflow cross sections of the variable metering restrictors assigned to the hydraulic cylinders 13 and 14 remain unchanged. It is also conceivable for the throughflow cross section of one variable metering restrictor to be increased in size and for the throughflow cross sections of the two other variable metering restrictors to be reduced in size. For example, the throughflow cross section of the variable metering restrictor assigned to the hydraulic cylinder 12 may be set to correspond to 88 liters. The throughflow cross sections of the two other variable metering restrictors then correspond to 55 liters.

Figure 3:
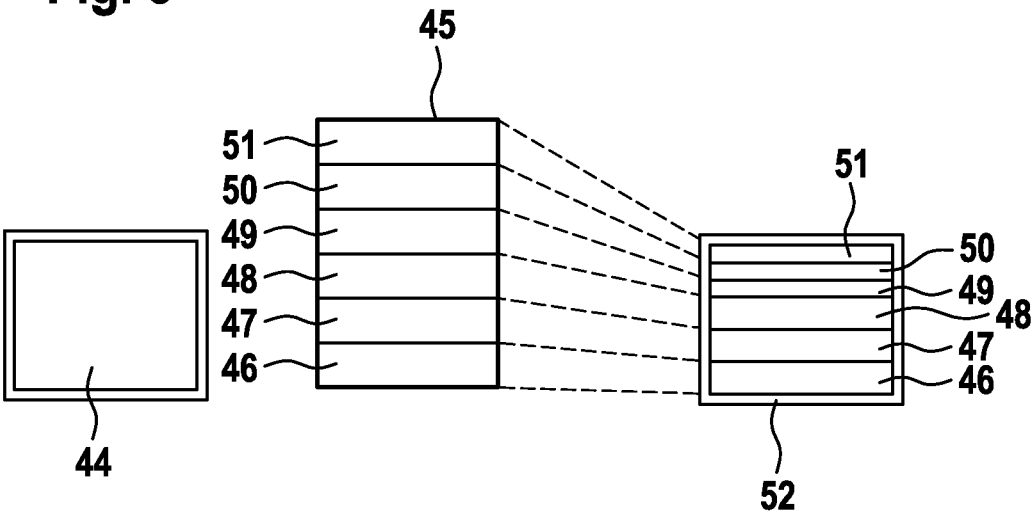
FIG. 3 shows the diagram with the exemplary distribution of a maximum conveying flow rate of a hydraulic pump.

The diagram as per FIG. 3 illustrates, as a further example, an approach in which, in the case of a supply deficit, lower-priority hydraulic consumers can still be supplied with a minimum flow rate and the pressure medium flow rates flowing to the preferential hydraulic consumers are reduced to a lesser degree, in relation to the pressure medium flow rates demanded by way of the joystick, than the volume flows to the lower-priority hydraulic consumers. The minimum flow rate for the lower-priority hydraulic consumers may be a percentage fraction of the maximum conveying flow rate that is presently possible at the present rotational speed of the hydraulic pump, or an absolute minimum flow rate.

In FIG. 3, the height of a rectangle which symbolizes a hydraulic pump 44 indicates the maximum conveying flow rate of the hydraulic pump 44. In a further rectangle 45, six hydraulic consumers 46 to 51 are symbolized by relatively small rectangles lying one above the other, wherein the height of a relatively small rectangle symbolizes the predefined individual pressure medium flow rate for a hydraulic consumer, and the height of the rectangle 45 symbolizes the sum of the individual pressure medium flow rates predefined for the six hydraulic consumers 46 to 51. The six hydraulic consumers have been divided into two groups, specifically a group with the hydraulic consumers 46, 47 and 48 and a group with the hydraulic consumers 49, 50 and 51, which are of lower priority than the consumers 46, 47 and 48 but which, in the case of the supply deficit, must still collectively be supplied with a minimum flow rate. The hydraulic consumers within a group are of equal priority.

From the height of the small rectangles, it can be seen that equal pressure medium flow rates are demanded for all six hydraulic consumers 46 to 51. Also, from the height of the rectangle 45, it can be seen that the sum of the demanded pressure medium flow rates greatly exceeds the maximum conveying flow rate of the hydraulic pump 45. The manner in which the maximum conveying flow rate of the hydraulic pump 44 is now distributed will become clear on the basis of the rectangle 52, the height of which corresponds to the height of the hydraulic pump 44 and thus symbolizes the maximum conveying flow rate of the hydraulic pump 44. Plotted one above the other in the rectangle 52 are six relatively small rectangles which individually represent the six consumers 46 to 51 and the height of which is a measure of the pressure medium flow rate actually flowing to a hydraulic consumer. It can be seen that the minimum flow rate provided in sum total for the hydraulic consumers 49, 50 and 51, which are of equal priority to one another, has been distributed uniformly between these hydraulic consumers. It can also be seen that the remaining flow rate available for distribution has been distributed uniformly between the hydraulic consumers 46, 47 and 48, which are of equal priority to one another, wherein a greater pressure medium flow rate flows to each preferential hydraulic consumer 46, 47 and 48 than to each lower-priority hydraulic consumer 49, 50 and 51.

Here, too, a numerical example will be considered in which, again, the maximum conveying flow rate of the hydraulic pump will be assumed to be 180 liters. It is the intention for 60 liters to flow to the hydraulic consumers 49, 50 and 51 even in the case of a supply deficit. Let it be assumed that, now, by way of one or more joysticks, equal pressure medium flow rates of 60 liters are demanded for all hydraulic consumers. The sum of the demanded pressure medium flow rates is thus 360 liters and greatly exceeds the maximum conveying flow rate of the hydraulic pump. The variable metering restrictors are thus actuated such that 20 liters of pressure medium flow to each of the hydraulic consumers 49, 50 and 51, and 40 liters of pressure medium flow to each of the hydraulic consumers 46, 47 and 48. The variable metering restrictors are thus actuated such that the throughflow cross section of the variable metering restrictors assigned to the preferential hydraulic consumers 46, 47 and 48 is twice the throughflow cross section of the variable metering restrictors assigned to the lower-priority hydraulic consumers 49, 50 and 51. It would thus be possible for the throughflow cross section of the variable metering restrictors assigned to the preferential hydraulic consumers 46, 47 and 48 to be set to a value that is provided for 60 liters in the case of a sufficient supply, and for the throughflow cross section of the variable metering restrictors assigned to the lower-priority hydraulic consumers 49, 50 and 51 to be set to a value that is provided for 30 liters in the case of a sufficient supply.

Figure 4:
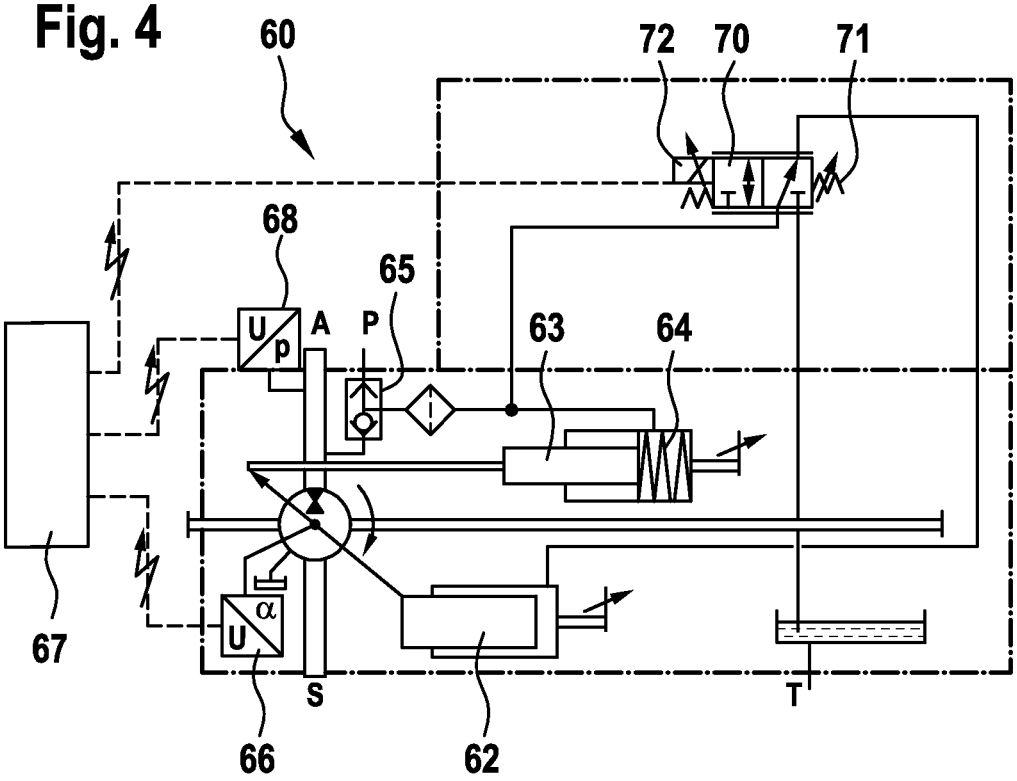
FIG. 4 shows the circuit diagram of a hydraulic pump with a pivot angle sensor together with an electronic control unit.

The circuit diagram as per FIG. 4 symbolizes an axial piston machine 60 of swashplate type of construction, wherein the pivot angle of the swashplate and thus the swept volume of the hydraulic pump 60 are controlled in closed-loop fashion. The swashplate is adjustable beyond zero, such that the axial piston machine 60 can, without a reversal of direction of rotation, be operated both as a hydraulic pump and as a hydraulic motor. Below, the axial piston machine 60 will be referred to for short as hydraulic pump 60. This has a tank connection S and a pressure connection A. The adjustment device for the adjustment of the swashplate comprises an actuating piston 62, which acts in one direction of adjustment, and an opposing piston 63, which acts together with a spring in the opposite direction and the effective surface area of which is smaller than the effective surface area of the actuating piston 62. By means of a shuttle valve 65, it is ascertained whether the pressure in the pressure connection A or an external pressure prevailing at a connection P is the higher pressure. The respectively higher pressure acts on the opposing piston 64. Owing to the spring 63, the swashplate assumes an end position when the hydraulic pump 60 is not in operation. The pivot angle of the swashplate is detected by means of a pivot angle sensor 66, which transmits a corresponding electrical signal to an electronic control unit 67. Aside from the pivot angle sensor 66, a pressure sensor 68 is also provided, by means of which the pressure in the pressure connection A can be detected and which likewise transmits an electrical signal to the control unit 67. Closed-loop pressure control and closed-loop power control of the hydraulic pump 60 are thus also possible.

The inflow and outflow of pressure medium to and from an actuating chamber into which the actuating piston 62 protrudes is controlled by means of a proportionally adjustable 3/2 directional valve 70 which, in a rest position which it assumes under the action of a pressure spring 71, connects the actuating chamber to its pressure connection at which, likewise, the higher pressure selected by the shuttle valve 65 prevails. By means of a proportional electromagnet 72, the 3/2 directional valve 70 can be moved into a position in which pressure medium can flow out from the actuating chamber into the interior of the housing of the hydraulic pump and onward from there via a tank connection T to a tank. The proportional electromagnet 72 is actuated by the electronic control unit 67, in a manner corresponding to the specifications imparted by way of a joystick (not illustrated in FIG. 4), the rotational speed of the hydraulic pump 60 and the signal output by the pivot angle sensor 66, such that the hydraulic pump 60 conveys the sum of the demanded individual pressure medium flow rates.

The actuation of variable metering restrictors by means of the electronic control unit 67 is performed by means of a hydraulic pump as per FIG. 4 in the case of a sufficient conveyed pressure medium flow rate and, in the case of undersaturation, in the same way as in the exemplary embodiments as per FIGS. 1 and 2, by means of the control unit 35 or by means of the control unit 36 respectively.

LIST OF REFERENCE DESIGNATIONS

10 Hydraulic pump
11 Load sensing closed-loop controller
12 Hydraulic cylinder
13 Hydraulic cylinder
14 Hydraulic cylinder
15 Hydraulic cylinder
16 Tank
17 Pump line
20 Hydraulic pump
21 EP closed-loop control unit
25 Valve arrangement
26 Valve arrangement
27 Valve arrangement
28 Valve arrangement
30 Variable metering restrictor
31 Pressure balance
33 Shuttle valve
35 Electronic control unit
36 Electronic control unit
37 Electrical line
38 Electrical line
39 Electrical line
40 Electrical line
41 Joystick
42 Input signal, rotational speed
44 Hydraulic pump
45 Rectangle
46 Hydraulic consumer
47 Hydraulic consumer
48 Hydraulic consumer
49 Hydraulic consumer
50 Hydraulic consumer
51 Hydraulic consumer
52 Rectangle
60 Hydraulic pump
62 Actuating piston
63 Opposing piston
64 Spring
65 Shuttle valve
66 Pivot angle sensor
67 Electronic control unit
68 Pressure sensor
70 3/2 directional valve
71 Pressure spring
72 Proportional electromagnet
S Tank connection
A Pressure connection
P External pressure connection
T Tank connection

The invention claimed is:

1. A hydraulic control arrangement for simultaneously supplying at least two hydraulic consumers with predefinable individual pressure medium flow rates, the hydraulic control arrangement comprising:

a hydraulic pump having an adjustable swept volume and configured to convey a sum of the predefinable individual pressure medium flow rates;

at least two valve arrangements, each respective valve arrangement comprising a respective variable metering restrictor and a respective pressure balance arranged downstream of the respective variable metering restrictor, wherein each respective pressure balance is configured to be acted on (i) in an opening direction by a pressure downstream of the respective variable metering restrictor, and (ii) in a closing direction by a highest load pressure or by a pressure derived therefrom, and wherein each respective valve arrangement is arranged between a pump line leading away from the hydraulic pump and a respective hydraulic consumer of the at least two hydraulic consumers; and an electronic control device configured to actuate the variable metering restrictors with control signals, such that throughflow cross sections of the variable metering restrictors have the same ratios with respect to one another as the predefinable individual pressure medium flow rates, wherein in a case that multiple of the variable metering restrictors are actuated simultaneously and, in an event of a supply deficit, the sum of the predefinable individual pressure medium flow rates exceeds a maximum conveying flow rate of the hydraulic pump and, for benefit of a preferential hydraulic consumer of the at least two hydraulic consumers, which is to be preferentially supplied with pressure medium, for the simultaneously actuated variable metering restrictors to be actuated with control signals, the ratios of which with respect to one another deviate from the ratios of the predefinable individual pressure medium flow rates, wherein, in the event of the supply deficit, the throughflow cross section of the variable metering restrictor assigned to the preferential hydraulic consumer is, in the case of the same predefinable individual pressure medium flow rate for the preferential consumer, increased in size in relation to a case of sufficient conveying flow rate, and wherein, in the case of the supply deficit, the throughflow cross section of the variable metering restrictor assigned to a lower-priority hydraulic consumer of the at least two hydraulic consumers is, in the case of the same predefinable individual pressure medium flow rate for the lower-priority hydraulic consumer, reduced in size in relation to a case of sufficient conveying flow rate.

2. The hydraulic control arrangement according to claim 1, wherein, in the event of the supply deficit, the variable metering restrictor assigned to the preferential hydraulic consumer and the variable metering restrictor assigned to a lower-priority hydraulic consumer of the at least two hydraulic consumers are actuated such that, in relation to the case of sufficient conveying flow rate, the ratio between the control signal for the variable metering restrictor assigned to the preferential hydraulic consumer and the control signal for the variable metering restrictor assigned to the lower-priority hydraulic consumer is increased, and the pressure medium flow rate flowing to the preferential hydraulic consumer is reduced.

3. The hydraulic control arrangement according to claim 2, wherein the variable metering restrictors are actuatable such that a minimum flow rate of pressure medium still flows to the lower-priority hydraulic consumer.

4. The hydraulic control arrangement according to claim 1, wherein:

a group includes at least two equally preferential hydraulic consumers of the at least two hydraulic consumers, and in the event of the supply deficit, the control signals to the variable metering restrictors assigned to the at least two equally preferential hydraulic consumers are changed proportionally in relation to the control signals in a case of sufficient conveying flow rate.

5. The hydraulic control arrangement according to claim 1, wherein:

a group includes at least two equally lower-priority hydraulic consumers of the at least two hydraulic consumers, and in the event of the supply deficit, the control signals to the variable metering restrictors assigned to the lower-priority hydraulic consumers are changed proportionally in relation to the control signals in a case of sufficient conveying flow rate.

6. The hydraulic control arrangement according to claim 5, wherein, in the event of the supply deficit, a minimum flow rate still flows, in sum total, to the group of at least two equally lower-priority hydraulic consumers.

7. The hydraulic control arrangement according to claim 1, wherein the electronic control device has an input for a signal which indicates a rotational speed of the hydraulic pump.

8. The hydraulic control arrangement according to claim 1, wherein the hydraulic pump is configured for control with closed-loop volume flow control by the electronic control device, with a control signal corresponding to the sum of the predefinable individual pressure medium flow rates taking into consideration a rotational speed of the hydraulic pump, such that the hydraulic pump conveys the sum of the predefinable individual pressure medium flow rates.

9. The hydraulic control arrangement according to claim 1, wherein:

the variable metering restrictors are each formed at a control slide valve, and the control slide valve is electrohydraulically actuatable.

10. The hydraulic control arrangement according to claim 1, further comprising:

at least one operator control element configured to generate signals corresponding to the predefinable individual pressure medium flow rates for the electronic control device.

* * * * *